US005312195A

United States Patent [19]

Grandke et al.

[11] Patent Number: 5,312,195

[45] Date of Patent: May 17, 1994

[54] ELECTROMAGNETIC DRIVE MECHANISM FOR THE PRINTING PIN OF A PRINT HEAD

[75] Inventors: Dieter Grandke, Kaufungen; Heinrich Hoffmann, Paderborn; Detlef Prahl, Bühl; Ralf Reinkemeier, Rietberg; Rolf Roeschlein, Paderborn, all of Fed. Rep. of Germany

[73] Assignee: Siemens Nixdorf Informationssysteme AG, Paderborn, Fed. Rep. of Germany

[21] Appl. No.: 741,463

[22] PCT Filed: Feb. 6, 1990

[86] PCT No.: PCT/EP90/00193

§ 371 Date: Sep. 26, 1991

§ 102(e) Date: Sep. 26, 1991

[87] PCT Pub. No.: WO90/09286

PCT Pub. Date: Aug. 23, 1990

[30] Foreign Application Priority Data

Feb. 10, 1989 [DE] Fed. Rep. of Germany ..... 3904056

[51] Int. Cl.[5] ..... B41J 9/00

[52] U.S. Cl. ..... 400/157.2; 400/124; 101/93.29

[58] Field of Search ..... 400/124, 157.1, 157.2; 101/93.29; 93.48

[56] References Cited

U.S. PATENT DOCUMENTS 4,840,501 6/1989 Wong ..... 400/124

FOREIGN PATENT DOCUMENTS 2056364 3/1972 Fed. Rep. of Germany ..... 400/124

*Primary Examiner*—David A. Wiecking
*Assistant Examiner*—Steven S. Kelley
*Attorney, Agent, or Firm*—Dykema Gossett

[57] ABSTRACT

An electromagnetic driving device for driving a print needle of a printer employing an E-shaped magnetic yoke. In order to improve print speed, the armature and arms of the yoke are specifically dimensioned. The precise lengths and widths of the armature and yoke provide an inductive circuit that minimizes both magnetic losses and inductance.

9 Claims, 1 Drawing Sheet

ELECTROMAGNETIC DRIVE MECHANISM FOR THE PRINTING PIN OF A PRINT HEAD

TECHNICAL FIELD

The invention concerns an electromagnetic drive mechanism for a printing pin of a dot matrix print head with an E-shaped magnetic frame whose center limb carries an electric field coil and with a longitudinal cutout blade that is wider than the outer limb and the center limb and is arranged on or near the outer limb of the magnetic frame in a swivelling manner with one end and whose other end protrudes over the other outer limb of the magnetic frame and acts upon the printing pin. Such a drive mechanism of this general type is disclosed in DE-AS 20 56 364.

BACKGROUND ART

Dot matrix print heads are used in electric printers and produce mosaic-like symbols that are compiled from printed dots produced by several printing pins. The quality of the symbols depends on the number of printing pins and/or on the frequency of their activation. The more printing pins are contained in a dot matrix print head, the better the ability of the printing dots to produce a symbol and the better the ability to read the same.

A dot matrix print head should contain the highest possible number of printing pins. In addition to this it should work at high speed and execute the movement of the printing pins with the highest possible impact, so that duplicates in the form of carbon copies can be produced during the printing process. These demands should also be fulfilled during long term use, which means that the dot matrix print head should have a high continuous output.

It has thus far not been possible to fulfill simultaneously the demands set for a dot matrix print head, which are high printing speeds, high impact and high continuous output. The main reason for this fact is the heat produced by the electromagnetic drive mechanisms for the printing pins, because one proceeded from the premise that a high activation frequency of a printing pin and a high impact force can only be obtained with strong energizing currents and/or a high number of ampere turns in large ferromagnetic circuits. A dot matrix print head constructed according to this principle has very high magnetic frame limbs with a large number of drive mechanisms in order to realize the large volume of iron and the large number of ampere turns. This fact was thus far predetermined by a circular arrangement of the drive mechanisms with printing pins that are arranged in the area of the center of the circle.

SUMMARY OF THE INVENTION

The objective of the invention is to create an electromagnetic drive mechanism for a printing pin of a dot matrix print head that fulfills the previously described demands in regard to printing speed, impact and continuous output while only necessitating a small structural space.

A drive mechanism of the initially mentioned kind for the solution of this objective is constructed in such a way that the cutout blade is wider than the magnetic frame limb over its entire length opposing the magnetic frame limbs while the average length of the iron path formed by the center limb and the outer limb is smaller than 30 mm. The inductivity of the magnetic circuit is less than 3 mH and the cutout blade has an effective magnetic cross section that is 10 to 50% smaller compared to the effective magnetic cross section of the outer limb.

The invention is based on the idea that even a small electromagnetic drive mechanism can transfer sufficiently high energy onto the printing pin, if a largely stable magnetic force is produced during the driving movement. It is known that an electromagnetic drive with a cutout blade has a hyperbolic, not a linear, magnetic force characteristic. If the cutout blade is at its largest distance from the magnetic frame and begins its driving movement from its resting position, the magnetic force produced is very small. However, it steadily increases according to the hyperbolic magnetic force characteristic as the distance from the cutout blade to the magnetic frame decreases. The invention makes it possible to produce a magnetic force already in the beginning phase of the movement of the cutout blade that approximately corresponds with the magnetic force obtained during the ending phase of the cutout blade movement. This can be explained by the fact that the dimensions and form of the cutout blade according to the invention lead to a considerable reduction of leakage in the area of the operational air gap of the drive mechanism. These leakages are an important factor, especially with drive mechanisms of such small dimensions, because they represent a considerably larger portion of the energy supplied than with comparatively larger electromagnetic drive mechanisms. Furthermore, the magnetic field is considerably smaller than conventionally dimensioned magnetic circuits and can thus be built up considerably faster, which is caused by the smaller inductivity of the magnetic circuit. It was determined that the full magnetic flux (for example after approximately 50 μsec) was already available when the cutout blade was still in its resting position. Since the mass of the cutout blade can be reduced, as compared to conventional drive mechanisms, this fact also contributes to improving the effectiveness of the energy transfer of the drive mechanism, because the inertia of the mass is reduced disproportionally and the possible acceleration and speed of the printing pin are correspondingly higher. These measures according to the invention make it possible to realize an activation frequency for the printing pin of more than 2400 Hz with very high impact force in a smaller drive mechanism whose iron paths have an average length of less than 30 mm, in which continuous operation for more than one hour still ensures the production of six carbon copies.

The invention thus introduces a drive mechanism suitable for application in a matrix needle head with a high number of printing pins and simultaneously fulfills the demand for high activation frequency, high impact force and high continuous output.

A further advantageous development of the drive mechanism according to the invention suggests that the width of the outer limb of the magnetic frame is up to 10% larger than their depth in the longitudinal direction of the cutout blade. This evidently leads to a particularly beneficial concentration of the magnetic flux in the corresponding operational gap between the cutout blade and an outer limb, by means of which a correspondingly beneficial concentration of the forces acting upon the cutout blade is obtained.

Independent of whether the outer limbs of the magnetic frame have a square or a rectangular cross section, a beneficial concentration of the magnetic forces acting upon the cutout blade can also be obtained by the fact that the other outer limb of the magnetic frame that forms the largest of the three operational air gaps together with the cutout blade is reduced on its frontal surface, as compared to its cross section. This is obtained by machining the inner surface or the opposing outer surface, and means that the effective magnetic cross section of this outer limb is practically reduced only in the area of the frontal surface.

In this case it is particularly advantageous if the width of the frontal surface is up to 100% larger than its depth.

In order to maintain the lowest possible mass of the cutout blade, the thickness of the same should have upper limitations. A particularly beneficial ratio between the widening beyond the width of the magnetic frame, as provided by the invention, and an enlargement of the effective magnetic cross section is obtained if the part of the iron path that extends through the cutout blade amounts to approximately 15% to 20% of the corresponding total iron path.

DESCRIPTION OF THE DRAWINGS

One embodiment of the invention is described in the following with the aid of figures. Wherein.

DETAILED DESCRIPTION OF THE PREFERRED EMBODIMENT

Figure 1:
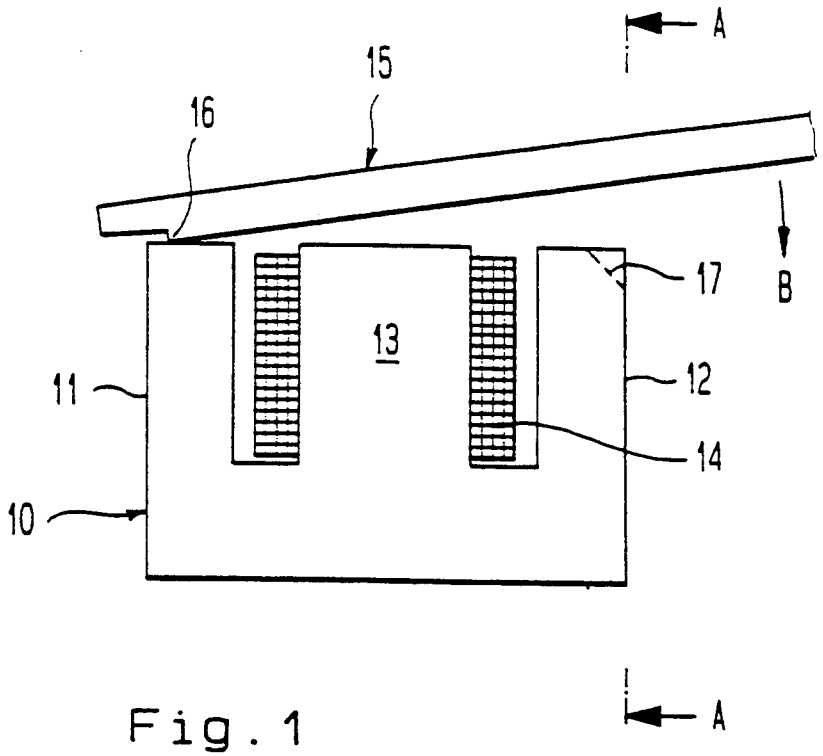
FIG. 1 a schematic cross section of a drive mechanism with cutout blade.

FIG. 1 shows an electromagnetic drive mechanism for the printing pin of a dot matrix print head in a schematic cross section. It is provided with an E-shaped magnetic frame (10) with two outer limbs (11 and 12) and a center limb (13) that carries an electric field coil (14). Above the magnetic frame (10) a cutout blade (15) is arranged, whose left end adjoins the frontal surface of the outer limb (11) with a support edge (16) and is retained in this position with construction elements not shown. The cutout blade (15) can be swivelled on this support edge (16) in such a way that it is attracted by the magnetic frame limbs (11, 12 and 13) when the energizing current for the field coil (14) is turned on and thus executes a pivoting movement in the direction of the arrow B shown in FIG. 1 until it adjoins the frontal surfaces of the outer limbs (11 and 12), as well as the center limb (13). A printing pin affixed to the right end of the cutout blade (15) that cannot be seen in the illustration according to FIG. 1 is activated transiently during this movement, so that the transient impact is able to print a dot-shaped symbol on the paper located behind a ribbon.

The use of an E-shaped magnetic frame has the advantage that the cutout blade only has to have half the width compared to a drive mechanism with a U-shaped magnetic frame, because the magnetic flux produced with the field coil on the center limb (13) is distributed over two iron circles extending over the outer limb (11) and the outer limb (12), so that the effective magnetic cross section of the cutout blade (15) must not be dimensioned for the entire magnetic flux produced, but only for half the magnetic flux. This fact fulfills the demand for a cutout blade with the lowest possible mass that can be activated with the highest possible frequencies.

Figure 2:
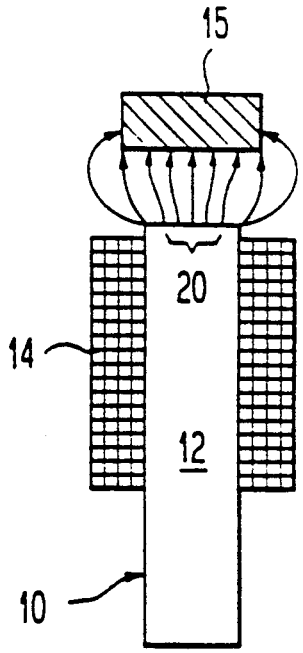
FIG. 2 a side view of the drive mechanism according to the section A—A in FIG. 1.

The manner of operation of the electromagnetic drive shown in FIG. 1 is generally known. The magnetic fluxes produced by the cutout blade (15) produce an electromagnetic force in the three operational air gaps between the limbs (11, 12 and 13) of the magnetic frame (10) and the cutout blade (15). The magnetic fluxes have a course that can be seen in the schematic illustration in FIG. 2. This course is furthermore improved by the widening of the cutout blade (15) compared to the width of the magnetic frame (10), as can be seen in FIG. 2. FIG. 2 also shows several schematically illustrated field lines that are directed from the outer limb (12) towards the cutout blade (15) and penetrate or exit vertically towards the surface of the corresponding elements (12 or 15). The magnetic flux between the outer limb (12) and the cutout blade (15) can be divided into three sections. First, there is the main flux that exits from the horizontal frontal surface of the outer limb (12) and has the approximate extent of the field lines (20). Furthermore, there is a secondary flux in the area to the left and right of the field lines (20) which no longer exits in the direction of the main flux at the edges of the frontal surface of the outer limb (12), in which field lines of the main flux alter their course in direction towards the cutout blade (15) immediately after exiting the outer limb (12) and penetrate vertically into the lower side of the same.

This is made possible by the fact that the cutout blade (15) has a larger width than the magnetic frame (10). If this were not the case, the corresponding secondary flux could considerably increase the portion of the leakage fields of the electromagnetic arrangement. Such leakage fields have field lines that do not extend in the direction of the main flux as do field lines (20) and thus do not contribute to the force produced by the electromagnetic fields. Such field lines are illustrated in FIG. 2 as the outermost field lines. They exit from the side surfaces of the outer limb (12) and penetrate into the side surfaces of the cutout blade (15). It can also be seen that the portion of such field lines that do not contribute to the electromagnetic force effect is smaller than with a smaller dimensioned cutout blade (15), in which the field lines of the secondary flux could have a course that would allow them to penetrate into the side surfaces of the cutout blade (15).

The inclusion of the secondary flux into the useable main flux creates a stronger force effect in the operational air gap between the outer limb (12) and the cutout blade (15), which is especially noticeable in the beginning phase of the movement of the cutout blade (15) towards the outer limb (12). The additionally obtained force effect represents a decreasing portion of the entire force produced when the distance between the cutout blade (15) and the outer limb (12) decreases, in which the entire force produced increases, which is caused by the reduction of the distance between the two elements.

The widening of the cutout blade (15) results in an electromagnetic force that already has a relatively high value at the beginning phase of the cutout blade movement. This also means that the work executed during the movement of the cutout blade and the energy transferred by this movement increases. An electromagnetic drive mechanism of this sort has a larger efficiency factor, so that it produces less heat loss than conventional drive mechanisms. Despite smaller structural space, this allows a higher activation frequency of the printing pin, the transfer of a larger amount of energy onto the printing pin and thus a higher number of carbon copies during the printing process, as well as a longer continuous output.

The distribution of the magnetic fluxes described in FIG. 2 is also valid for the operational air gaps between the other outer limb (11), as well as the center limb (13) of the magnetic frame (10) and the cutout blade (15).

The beneficial magnetic flux distribution obtained with the invention can be further improved if iron material is removed from the outside of the outer limb (12) that forms the largest operational air gap together with the cutout blade (15), as it is indicated in FIG. 1 by the broken line (17). This means a reduction of the frontal surface of the outer limb (12), which determines the size of the operational air gap with the cutout blade (15), as compared to the effective magnetic iron cross section of the outer limb (12). This causes a concentration of the magnetic flux in the operational air gap in such a way that the magnetic induction is increased at this specific location. This has a particularly beneficial effect on the force production in the beginning phase of the cutout blade movement and thus contributes to a linearization of the magnetic force characteristic.

A similar effect can also be obtained by removal of the material on the inner side of the outer limb (12) or without special treatment of the same, if the outer limb (12) of the magnetic frame (10) is manufactured with a cross section other than square and is up to 10% wider than deep.

The widening of the cutout blade (15) can lead to an enlargement of the magnetically effective cross section of the cutout blade, but can also be a reason for the reduction of the thickness of the cutout blade. It was determined that a particularly beneficial ratio of these values can be obtained if the thickness of the cutout blade (15) is chosen in such a way that a portion of approximately 15 to 25% of the corresponding iron path extends through the cutout blade.

We claim:

1. An electromagnetic drive mechanism for a printing pin in a dot matrix printhead, comprising:

an E-shaped magnetic frame having a pair of outer limbs, and a center limb carrying an electric field coil; and, an elongate cutout blade opposing said limbs and having a width greater over its entire length than that of said limbs, said blade having one end thereof pivotally mounted on one end of said magnetic frame, the other end of said blade extending over said magnetic frame and acting on said pin, the average length of a magnetic flux path formed by the center limb and one of the outer limbs being less than 30 mm, and the inductance of the resulting magnetic circuit being less than 3 mH, said blade having a magnetically effective cross-section 10 to 50% less than the magnetically effective cross-section of said outer limbs.

2. A drive mechanism according to claim 1, wherein the width of the outer limbs of the magnetic frame is between zero and 10% larger than their depth in the longitudinal direction of the cutout blade.

3. A drive mechanism according to claim 1, wherein the outer limb of the magnetic frame has a reduced frontal surface area.

4. A drive mechanism according to claim 2, wherein the outer limb of the magnetic frame has a reduced frontal surface area.

5. A drive mechanism according to claim 3, wherein the width of the frontal surface area is up to 100% larger than its depth.

6. A drive mechanism according to claim 1, wherein the portion of the magnetic flux path extending through the cutout blade is between 15 and 25% of the corresponding total iron path.

7. A drive mechanism according to claim 2, wherein the portion of the magnetic flux path extending through the cutout blade is between 15 and 25% of the corresponding total iron path.

8. A drive mechanism according to claim 3, wherein the portion of the magnetic flux path extending through the cutout blade is between 15 and 25% of the corresponding total iron path.

9. A drive mechanism according to claim 4, wherein the portion of the magnetic flux path extending through the cutout blade is between 15 and 25% of the corresponding total iron path.

* * * * *